US006948487B2

(12) United States Patent
Rice et al.

(10) Patent No.: US 6,948,487 B2
(45) Date of Patent: Sep. 27, 2005

(54) PAINTBALL MARKER CONTROL SYSTEM

(75) Inventors: John Ronald Rice, Staffordshire (GB); Nicholas John Marks, Staffordshire (GB)

(73) Assignee: NPF Limited, Birmingham (GB)

( * ) Notice: Subject to any disclaimer, the term of this patent is extended or adjusted under 35 U.S.C. 154(b) by 0 days.

(21) Appl. No.: 10/248,396

(22) Filed: Jan. 15, 2003

(65) Prior Publication Data

US 2003/0131834 A1 Jul. 17, 2003

(30) Foreign Application Priority Data

Jan. 15, 2002 (GB) ..... 0200811

(51) Int. Cl.[7] ..... F41B 11/00
(52) U.S. Cl. ..... 124/32; 124/77
(58) Field of Search ..... 124/32, 77

(56) References Cited

U.S. PATENT DOCUMENTS 5,727,538 A 3/1998 Ellis
6,062,208 A * 5/2000 Seefeldt et al. ..... 124/71
6,142,137 A 11/2000 MacLaughlin
6,523,534 B2 * 2/2003 Juan ..... 124/32
6,615,814 B1 * 9/2003 Rice et al. ..... 124/71

FOREIGN PATENT DOCUMENTS

GB 2342710 A 4/2000

* cited by examiner

*Primary Examiner*—John A. Ricci
(74) *Attorney, Agent, or Firm*—Vedder Price Kaufman & Kammholz

(57) ABSTRACT

A control system for a paintball marker having a breach, the control system comprising a contact sensor, a controller, and a paintball firing mechanism, the sensor being arranged to be located within the paintball marker, to sense a paintball being in contact therewith and to produce a signal indicative of the presence of the paintball within the breech, and the controller being arranged to receive the signal and to control the actuation of the firing mechanism in response to the signal.

20 Claims, 3 Drawing Sheets

PAINTBALL MARKER CONTROL SYSTEM

BACKGROUND OF INVENTION

This invention relates to a paintball marker control system. More particularly, but not exclusively, it relates to a control system for regulating the rate of fire of a marker.

The control of paintball markers is of great importance both from a safety viewpoint and also with regard to preventing blockages due to paintballs rupturing within the marker. Safety is a major issue due to the ejection of high velocity projectiles, paintballs, from markers and the possibility of the accidental discharge of paintballs in areas where protective clothing is not mandatory leading to injuries.

Automatic and semi-automatic paintball markers use a compressed gas that is released in order to fire a paintball, to move a bolt that loads the next paintball ready for firing. The bolt is driven back by the gas in order to allow the next paintball to enter the marker's breech. When the marker is fired the bolt moves forward, typically under spring action, partially sealing the breech, and a hammer strikes a gas entry valve to open it. The open valve allows the compressed gas to enter the breech and force the paintball out of the marker. Some of the gas is used to move the bolt back to its loading position and the valve closes.

For a "perfect" paintball it is possible to fire one paintball every 7 ms. A "perfect" paintball is assumed to be perfectly spherical and to fit exactly in the breech and barrel of the marker. Clearly this is not always the case as paintballs can be filled to varying degrees, deformed and have variable diameters. Thus a timing cycle for firing of 14 ms is typically used in order to allow for imperfections in paintballs. This is a compromise between an efficient use of the compressed gas, which decreases with increased firing cycle time, and allowing for variations in the paintballs to provide a substantially uniform firing characteristic for a marker.

The rupturing of paintballs within a marker, either by being "chopped" by the marker's bolt as they fall into the marker's breech, or simply by overpressurizing the breech when firing, can result in internal surfaces of the marker becoming coated with paint. Ruptured paintballs can, eventually, result in the marker not firing properly or indeed jamming.

Current systems for controlling paintball markers typically employ optical sensors to sense the presence of a paintball in the breech of the marker. These systems seek to prevent the accidental rupturing and/or discharge of paintballs by preventing firing of the marker, for example, when a paintball is not wholly within the marker's breech. These systems rely on either sensing reflected light from a paintball in the breech or the interruption of a beam of light as a paintball falls into the breech.

All such optical control systems have a problem, in that, should a paintball rupture in the breech, the optics of the system can become fouled, rendering the system unreliable or possibly even inoperable. Also optical systems must have their sensors screened from stray light sources in order to prevent spurious output signals.

Additionally, reflected light systems have the attendant problem that paintballs typically have multicoloured casings, for example yellow and black, and each colour will have a different reflectivity, thus causing difficulties in measuring the reflected light.

Optical beam interruption systems suffer from the disadvantage that as a paintball enters the breech a lower surface of it will break the beam. This allows the marker's bolt to be thrown forward before the paintball has fully entered the breech and chop the paintball.

One particular control system as disclosed in U.S. Pat. No. 5,727,538 utilizes position sensors to monitor the location of the bolt in conjunction with an electronic sensor to detect the presence of a paintball in order to limit the opportunities for chopping of paintballs. The use of a number of sensors is complicated and can lead to difficulties in implementation. This document also discloses the use of a single optical sensor but states that such a sensor is unreliable because the sensor can readily become clogged with dirt or paint from ruptured paintballs.

SUMMARY OF INVENTION

According to a first aspect of the present invention there is provided a control system for a paintball marker having a breech, the control system comprising a contact sensor, a controller, and a paintball firing mechanism, the sensor being arranged to be located within the paintball marker, to sense a paintball being in contact therewith, and to produce a signal indicative of the presence of said paintball within said breech, and the controller being arranged to receive said signal and to control the actuation of said firing mechanism in response to said signal.

It will be appreciated that the term "contact" as used herein is taken to mean a force exerted upon, or movement or deflection of the sensing means.

Preferably the contact sensor is a differential sensor, and more preferably, a piezoelectric sensor. Even more preferably the contact sensor is arranged to be located opposite a point of entry of a paintball into the breech.

The controller may be arranged to be operable by a user to control said rate of actuation of the firing mechanism in the absence of a signal indicative of the presence of a paintball. The controller may be arranged to be operable by a user to adjust a sensitivity level of the control system to the arrival of a paintball in the breech. The controller may be arranged to threshold the signal to discriminate between the arrival of a paintball in the breech and other vibrations.

The system may include a visual status indicator arranged to indicate whether the control system is activated.

The controller may be arranged to prevent the actuation of the firing mechanism in the absence of a signal indicative of the presence of a paintball. Alternatively, the control means may be arranged to limit the rate of actuation of the firing mechanism. The controller may in other cases be arranged to define a trigger pull time and to cause firing of a shot at a firing time after said trigger pull time, and to provide a delay period between the trigger pull time and the firing time in the absence of said signal.

The control system may include analogue to digital converter for digitising the signal. The control system may be arranged to threshold the signal following its conversion to a digital form.

According to a second aspect of the present invention there is provided a paintball marker control system comprising vibration sensor, a controller and an alarm, the sensor being arranged to be located within a paintball marker, and to sense movement of the marker, the controller being arranged to receive a signal from the sensor indicative of the movement of the marker and to control the actuation of the alarm in response to said signal.

The alarm may be an audible alarm. Alternatively, or additionally, the alarm may include a visual indicator.

The invention will now be described, by way of example only, with reference to the accompanying drawings.

DETAILED DESCRIPTION

Figure 1:
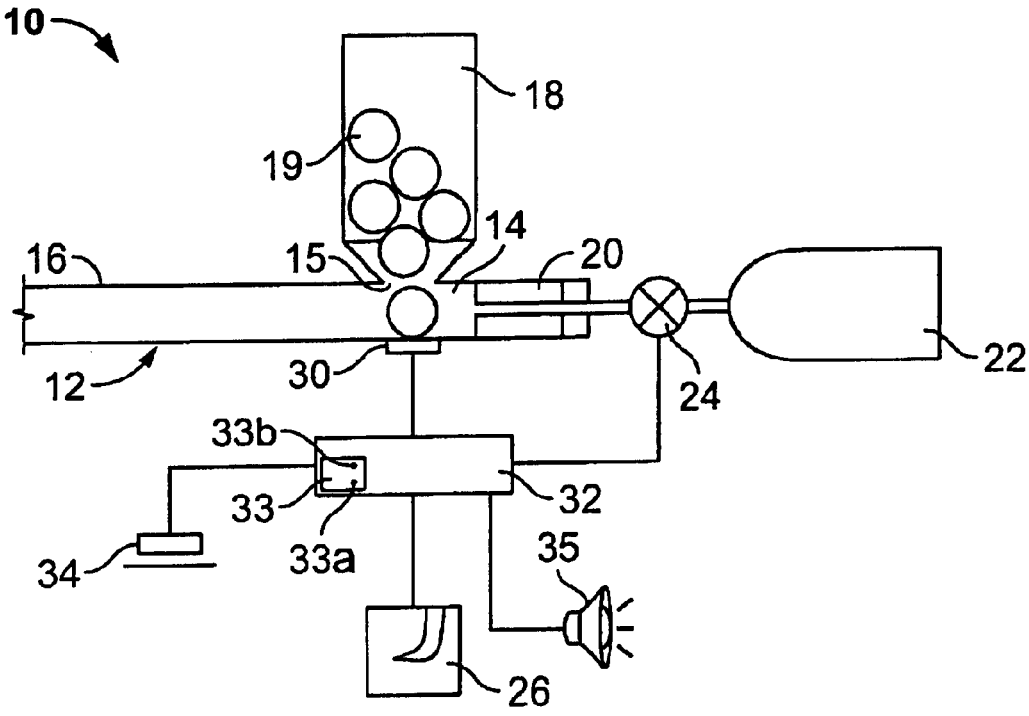
FIG. 1 is a schematic diagram of a paintball marker including a control system according to a first embodiment of the present invention.

Referring now to FIG. 1, a paintball marker 10 according to a first embodiment of the invention comprises a body 12 having a breech 14 and a barrel 16, a paintball hopper 18 containing paintballs 19, a bolt 20, a compressed gas consister 22, a firing mechanism typically in the form of an electronically actuated valve 24, and a trigger 26.

The hopper 18 opens into the breech 14 at a point of entry 15 adjacent the bolt 20 such that paintballs 19 can fall from the hopper 18 into the breech 14, with the bolt 20 in its retracted position. A pressure sensor 30, typically a piezoelectric pressure sensor or a strain gauge, is mounted in the breech 14 under the opening from the hopper 18 to the breech 14 and detects the presence of a paintball 19 in the breech 14. The output from the sensor 30 is passed to a control unit 32, typically a microprocessor, that is powered by a battery 34.

Figure 2:
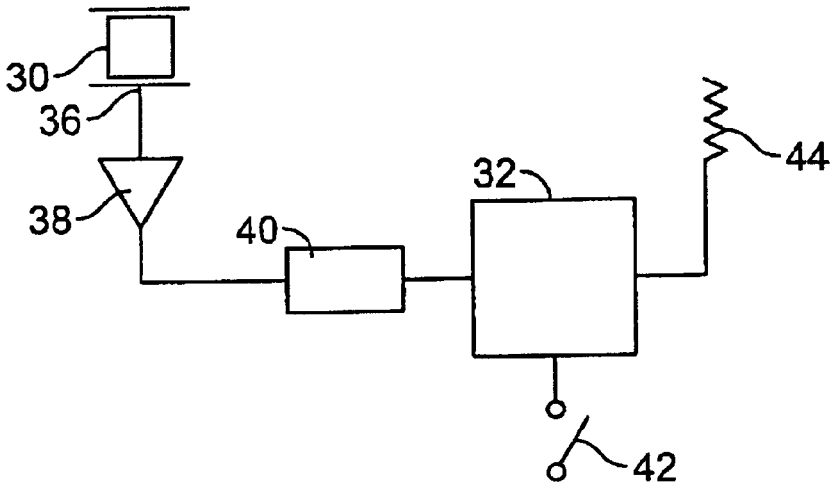
FIG. 2 is a block diagram of a control system according to the present invention.

The sensor 30 generates a differential output signal, i.e. a signal which varies with the rate of change of pressure on the sensor 30. As shown in FIG. 2, an output 36 of the sensor 30 is connected to an analogue amplifier 38 that amplifies the output signal from the sensor 30. The amplified signal is then passed to an analogue to digital converter (ADC) 40. The ADC 40 is typically an 8-bit ADC giving 256 levels of digitisation. The digitised signal passes to the control unit 32.

A user pulls the trigger 26, effectively closing a switch 42 and sending an input to the control unit 32. The control unit 32 monitors a timing cycle associated with the action of the bolt 20, typically 14 ms per cycle of the bolt 20 and unless the control unit 32 has received an input signal corresponding to a paintball striking the sensor 30 prior to the trigger 26 being pulled, typically 0.05 s before, the timing cycle is interrupted and the control unit 32 limits the rate of actuation of the valve 24. When the marker 10 is in an automatic or semi-automatic mode the control unit 32 monitors the output of the sensor 30 before each timing cycle whilst the trigger 26 is pulled. If the control unit 32 has not received an input signal corresponding to a paintball striking the sensor 30 prior to the start of the timing cycle the timing cycle is interrupted and the control unit 32 limits the rate of actuation of the valve 24.

The rate of actuation of the valve 24 at a limited rate is set by the user, typically entering a value on a control panel 33, typically using buttons 33*a,b*, of the marker 10. Typical limited rates of actuation of the valve 24 will be either zero, two or four shots per second. This reduces the chances of a paintball falling into the breech 14 and being chopped by the bolt 20 compared to the normal rate of actuation of the valve 24, typically twenty times per second, by allowing more time for the paintball to fully enter the breech between shots. This reduced rate of fire of the marker 10 will continue until the sensor 30 is struck by a paintball whereupon the normal rate of fire is resumed.

Although shown in FIG. 2 as being controlled by a solenoids 44 it will be appreciated that the valve 24 may be controlled by any suitable means, for example servo-motors or piezo-electric drivers.

As stated above the usual rate of fire of a paintball marker 10 when in automatic mode is typically twenty paintballs per second. However, the vibration signature of a paintball striking the sensor 30 and the action of the bolt 20 that are detected by the sensor 30 typically lasts for 0.09 seconds, almost twice the firing time of a paintball.

Figure 3:
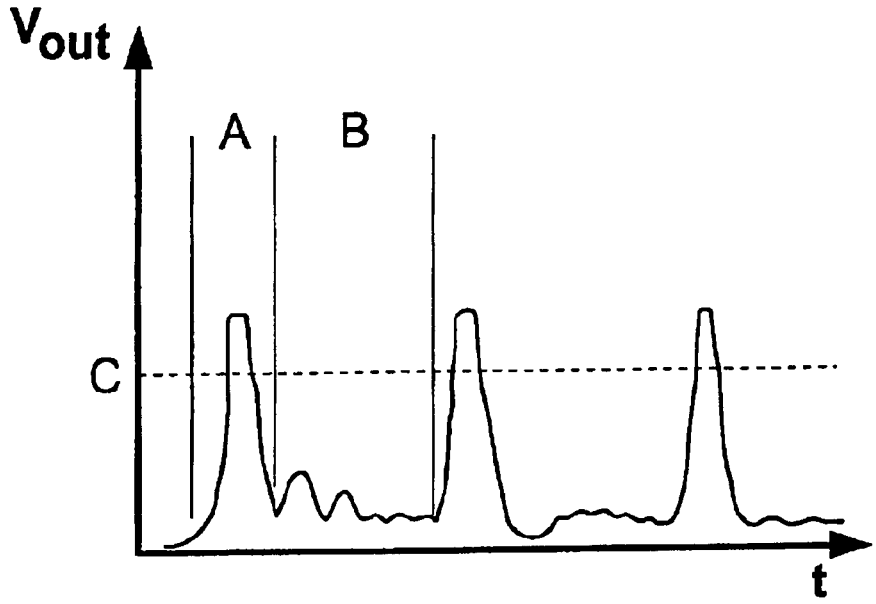
FIG. 3 is a schematic representation of an output signal from a sensor of a control system according to the present invention.
Figure 4:
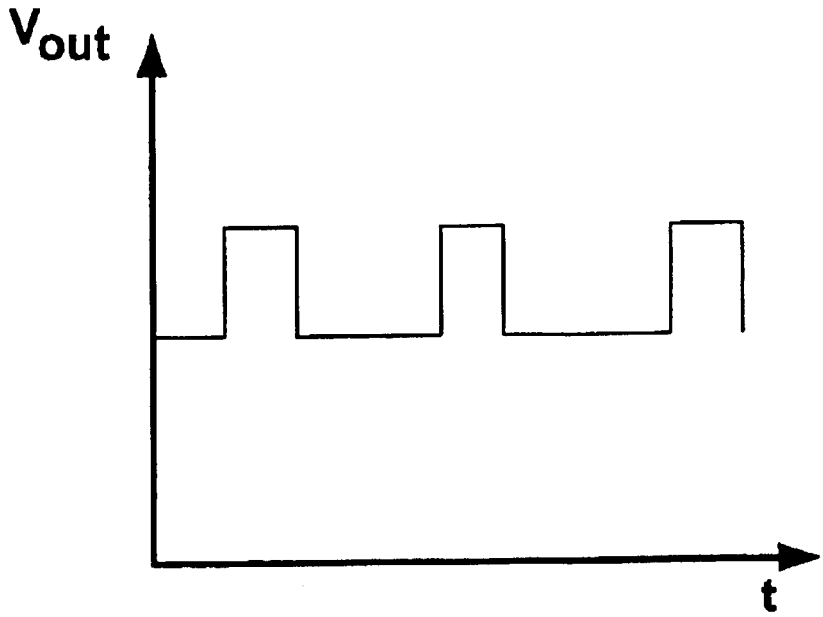
FIG. 4 is a schematic representation of a series of threshold signals from a sensor of a control system according to the present invention.

Referring now to FIG. 3, a portion of the signal corresponding to a paintball striking the sensor 30 has a very sharp peak region (A) that falls away rapidly to a second region (B) corresponding to the action of the bolt 20 and vibrations of the marker 10. The peak region (A) has a magnitude that is typically twice that of the second region (B). A threshold (C) is set so as to exclude the second region (B) and a significant proportion of the peak region (A) from further signal processing. Although this thresholding can be carried out upon the analogue signal it is usual, and more convenient, to threshold the digitised signal as shown in FIG. 4. This thresholding effectively reduces the lengths of the signal associated with a paintball striking the sensor so that only the first peak is detected and thus only a single peak per ball is registered by the control unit 32. This therefore allows a rate of detection of up to twenty paintballs per second, this being the normal rate of fire of the marker 10.

Figure 5:
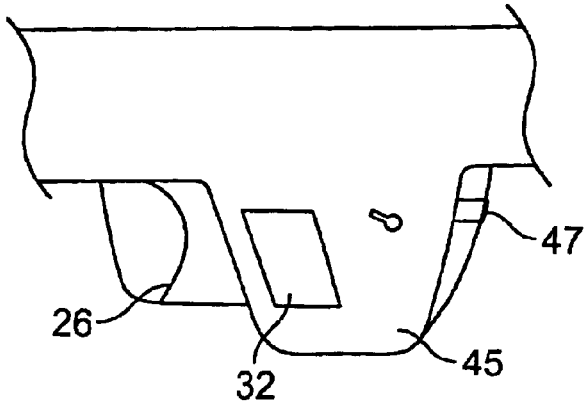
FIG. 5 is a schematic representation of a grip of a paintball marker including a control system according to the present invention.

By setting the sensitivity threshold very low using the buttons 33*a,b* on the control panel 33, it is possible to use the sensor 30 as a vibration sensor. This allows the sensor 30 to actuate an alarm 35 if the marker is moved by an unauthorised user, thus acting as a deterrent to theft. The alarm 35 may be an audible alarm. Alternatively, or additionally, the alarm may be a visual alarm, for example the LED 47 of FIG. 5. Referring to FIG. 5, the marker 10 has a grip 45, that incorporates the trigger 26, upon which is located an LED 47 and a switch 49. A user can toggle the control unit 32 off and on by using the switch 49. Thus, the user can choose whether to reduce the risk of chopping of paintballs by having the control unit switched on, or not. The LED 47 is a visual indicator of whether the control unit 32 is activated. The LED 47 will typically be in a steady "on" state when the marker 10 is armed and the firing rate limiting function of the control unit 32 is not active and will flash when the firing rate limiting function of the control unit 32 is active.

Figure 6:
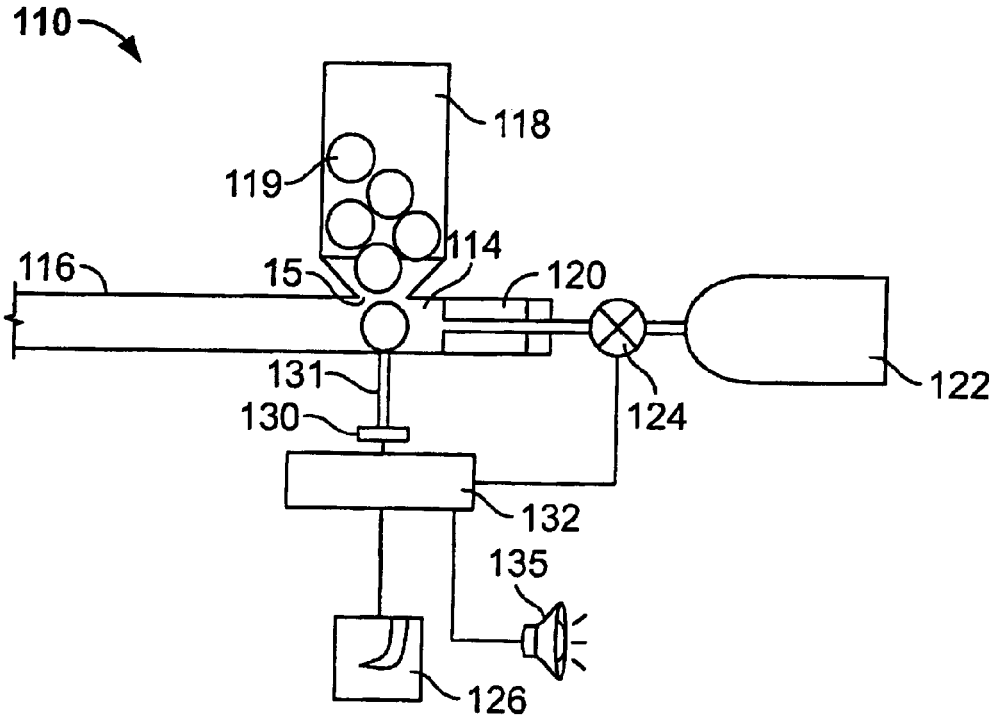
FIG. 6 is a schematic diagram of a paintball marker including a control system according to a second embodiment of the present invention.

Referring to FIG. 6, in a paintball marker according to a second embodiment of the invention many features correspond to those in the first embodiment, and are indicated by the same reference numeral increased by 100. The only significant difference is that the piezoelectric sensor 130 is not located in the breech 114, but is located a short distance below it. A sensor rod 131 is supported in a vertical position with its upper end 131*a* projecting into the bottom of the breech 114 opposite the point of entry 115 of the paintballs 119 from the hopper 118. The lower end 131*b* of the sensor rod 131 is in contact with a piezoelectric sensor 130. The sensor rod 131 is supported so that it can move vertically to transmit forces, applied to its upper end 131*a* by the paintballs 119 entering the breech, to the sensor 130.

It is possible to modify the operation of either of the embodiments described above, and one modification will now be described with reference to FIGS. 1 to 5. In this modification, if a trigger pull is registered by the control unit 32 it still checks whether a signal from the sensor 30, indicative of the arrival of a paintball in the breach 114, has been received since the last shot was fired. If it has, then the shot is fired immediately. If not, instead of varying the firing rate, the control unit 32 starts a delay for the one shot that has been requested by the trigger pull. Typically the delay might be for 35 ms. If within that 35 ms delay a signal is received from the sensor 30 indicating the arrival of a paintball 19 in the breech 14, then the shot is immediately fired. If the delay period expires without the arrival of a paintball 19 in the breech 14 being detected, then the shot is fired anyway. There is therefore a maximum delay between the trigger pull and the firing of the shot, in this case of 35 ms, which will occur if no paintballs are sensed in the breech at all.

The advantage of this arrangement is that the marker will respond to each normal pull of the trigger by firing a shot within, at most, the delay period. This ensures that the player feels that the marker is responding to his pulling of the trigger.

The delay period can be adjusted using the buttons 33*a*, 33*b* on the marker grip. Decreasing the delay period will ensure that the marker fires more quickly for each trigger pull, but can increase the likelihood of chopping paintballs. Increasing the delay period reduces the likelihood of chopping paintballs, but can make the marker feel more as if it is not responding as quicker as the player might want. The delay period can be adjusted from 10 ms to 90 ms in 5 ms intervals.

It will be appreciated that the contact sensor can take a number of different forms, and can essentially comprise any sensor which senses contact with a paintball. As well as piezoelectric sensors or strain gauges, vibration sensors could be used, for example.

What is claimed is:

1. A control system for a paintball marker having a breech, the control system comprising a contact sensor, a controller mechanism, and a paintball firing mechanism, the sensor sized, constructed and arranged to be located within the paintball marker, for sensing a paintball in contact therewith, and for producing a signal indicative of the presence of said paintball within said breech, and the controller mechanism being constructed and arranged for receiving said signal and for controlling the actuation of said firing mechanism in response to said signal;

wherein the contact sensor is a differential sensor arranged to produce said signal in response to a change in position of the paintball; and wherein the contact sensor is a piezoelectric sensor.

2. A system as claimed in claim 1, wherein the controller mechanism is constructed and arranged to define a trigger pull time and to cause firing of a shot at a firing time after said trigger pull time, and to provide a delay period between the trigger pull time and the firing time in the absence of said signal.

3. A system as claimed in claim 2, wherein the controller mechanism is constructed and arranged to define a trigger pull time and to cause firing of a shot substantially instantaneously on detection of said signal if said signal is detected during said delay period at a firing time after said trigger pull time, and to provide a delay period between the trigger pull time and the firing time in the absence of said signal; and wherein the controller mechanism is constructed and arranged to cause firing of a shot substantially instantaneously on detection of said signal if said signal is detected during said delay period.

4. A system as claimed in claim 2 and further comprising a user input mechanism constructed and arranged to allow adjustment of said delay period.

5. A system as claimed in claim 4, wherein said delay period is adjustable between about 30 ms and about 40 ms.

6. A system as claimed in claim 4 and further comprising a user input mechanism constructed and arranged to allow adjustment of said delay period; and wherein said delay period is adjustable between about 20 ms and about 50 ms.

7. A system as claimed in claim 4 wherein the delay period is adjustable between about 10 ms and about 90 ms.

8. A system as claimed in claim 1, wherein the controller mechanism comprises a user adjustable mechanism for adjusting the sensitivity level of the control system relative to the arrival of a paintball in the breech.

9. A system as claimed in claim 1, wherein the controller mechanism is constructed and arranged to provide a threshold for said signal and to discriminate between the arrival of a paintball in the breech and other vibrations, by means of said threshold.

10. A control system for a paintball marker having a breech, the control system comprising a contact sensor, a controller mechanism, and a paintball firing mechanism, the sensor sized, constructed and arranged to be located within the paintball marker, for sensing paintball in contact therewith, and for producing a signal indicative of the presence of said paintball within said breech, and the controller mechanism being constructed and arranged for receiving said signal and for controlling the actuation of said firing mechanism in response to said signal;

wherein the controller mechanism includes an analogue to digital converter for digitizing said signal and the controller mechanism is constructed and arranged to provide a threshold for the signal following its conversion to a digital form.

11. A control system for a paintball marker having a breech, the control system comprising a paintball firing mechanism and sensor means located within the paintball marker for sensing a paintball in contact therewith, and for a signal indicative of the presence of said paintball within said breech, and controller means for receiving said signal and for controlling the actuation of said firing mechanism in response to said signal;

wherein the sensor means is a differential sensor arranged to produce said signal in response to a change in position of the paintball; and wherein the sensor means is a piezoelectric sensor.

12. A system as claimed in claim 11, wherein the controller means comprises user adjustable means for adjusting the sensitivity level of the control system to the arrival of a paintball in the breech.

13. A system as claimed in claim 11, wherein the controller means comprises means for providing a threshold signal for discriminating between arrival of a paintball in the breech and other vibrations.

14. A system as claimed in claim 13, wherein the controller means comprises an analogue to digital converter for digitizing said signal and means for providing a threshold signal following conversion of said signal to a digital form.

15. A control system for a paintball marker having a breech, the control system comprising a paintball firing mechanism and sensor means located within the paintball marker for sensing a paintball in contact therewith, and for a signal indicative of the presence of said paintball within said breech, and controller means for receiving said signal and for controlling the actuation of said firing mechanism in response to said signal;

wherein the sensor means is a differential sensor arranged to produce said signal in response to a change in position of the paintball; and wherein the controller means comprises means for defining a trigger pull time and for causing firing of a shot at a firing time after said trigger pull time, and for providing a delay period between the trigger pull time and the firing time in the absence of said signal.

16. A system as claimed in claim 15, wherein the controller means comprises means for causing firing of a shot substantially instantaneously on detection of said signal is detected during said delay period.

17. A system as claimed in claim 15 and further comprising a user input means for allowing adjustment of said delay period.

18. A system as claimed in claim 17, wherein said delay period is adjustable between about 30 ms and about 40 ms.

19. A system as claimed in claim 15, wherein said delay period is adjustable between about 20 ms and about 50 ms.

20. A system as claimed in claim 19, wherein the delay period is adjustable between about 10 ms and about 90 ms.

* * * * *